US011560208B2

(12) United States Patent
Siskar et al.

(10) Patent No.: US 11,560,208 B2
(45) Date of Patent: Jan. 24, 2023

(54) HARNESS SPREADER BAR FOR WIND SPORTS

(71) Applicants: Gary Siskar, Hood River, OR (US); Coleman Buckley, Mill Valley, CA (US); Julien Fillion, Montreal (CA)

(72) Inventors: Gary Siskar, Hood River, OR (US); Coleman Buckley, Mill Valley, CA (US); Julien Fillion, Montreal (CA)

( * ) Notice: Subject to any disclaimer, the term of this patent is extended or adjusted under 35 U.S.C. 154(b) by 0 days.

(21) Appl. No.: 17/300,423

(22) Filed: Jun. 25, 2021

(65) Prior Publication Data

US 2022/0017199 A1 Jan. 20, 2022

Related U.S. Application Data

(60) Provisional application No. 63/102,657, filed on Jun. 25, 2020.

(51) Int. Cl.
*B63H 8/58* (2020.01)
*B63H 8/16* (2020.01)

(52) U.S. Cl.
CPC ..... *B63H 8/58* (2020.02); *B63H 8/16* (2020.02)

(58) Field of Classification Search
CPC ... B63H 8/58; B63H 8/56; B63H 8/54; B63H 8/16
See application file for complete search history.

(56) References Cited

U.S. PATENT DOCUMENTS

2019/0344863 A1* 11/2019 Gerhart ..... B63H 8/56

FOREIGN PATENT DOCUMENTS

EP 3597522 A1 * 1/2020 ..... B63H 8/56

* cited by examiner

*Primary Examiner* — Andrew Polay

(57) ABSTRACT

A spreader bar for a wind sport harness, with a front member having at least one release latch on one end. A structural side member is releasably securable to the release latch. A bracket for receiving the side member is configured to releasably secure the side member. The length of the side member extending through the bracket is adjustable. Closing the at least one release latch can create a unitary mechanical connection around a user.

19 Claims, 5 Drawing Sheets

HARNESS SPREADER BAR FOR WIND SPORTS

CROSS-REFERENCE TO RELATED APPLICATIONS

This application claims priority from and benefit of U.S. Provisional Patent Application Ser. No. 63/102,657, filed Jun. 25, 2020, entitled "HARNESS SPREADER BAR FOR WIND SPORTS," which is incorporated by reference in its entirety.

FIELD OF THE PRESENT INVENTION

The present invention relates generally to an article worn by a user to aid in the control of a wind powered device, such as a kite, wing, sail or the like. More particularly, the invention relates to an adjustable spreader bar system worn by the user having one or more points of attachment to be releasably secured to the wind powered device.

BACKGROUND OF THE INVENTION

Recreational pursuits and other applications involving the utilization of energy from the wind to propel the user typically involve a kite or sail that is operated by the user to interact with the wind and generate propulsive force. Although the hands and arms are often used to control aspects of kite or sail operation including trim, attitude and positioning, the generated forces can be significant and the user may quickly tire if there is no provision for distributing those forces to other body parts. Thus, it may be desirable to provide a point of attachment associated with the core of the user's body to offload a portion of these forces to larger muscle groups such as the legs and abdomen as well as allowing the user's body to be used as a counterweight. As will be appreciated, one technique for achieving these goals is to use a harness that may be secured to the user's body and which may provide at least one point of attachment to the kite or sail, such as hook or a line which can be clipped into on a spreader bar of the harness.

There are a number of characteristics that are considered beneficial for a harness to be used for wind sports. In particular, the harness should offer a robust connection to the user that is stable and remains at the intended location on the user while being able to withstand the forces generated by the kite or sail and the varying directions with which those forces may be imparted to the user. Similarly, it is desirable to distribute the forces transferred from the kite or sail to the user's body over a relatively large area and to reduce concentration of such forces. Further, even though a secure connection to the user is advantageous, it is also beneficial to make the harness as comfortable as possible to allow the user to wear it for extended periods of time. Still further, the harness may be used to support portions of the user's body that are in contact with it to extend the period of time the user is able to engage in the wind sport activity. During usage, it would be helpful for the fit of the harness to remain constant, for example to avoid the potential for loosening and suffering a degradation in the intended functionality. Ease of use would also benefit from avoiding the need to readjust the fit each time the same user wears the harness. As will be described in the following materials, the adjustable spreader bar systems of this disclosure satisfy these and other needs.

SUMMARY

This disclosure includes a spreader bar for a wind sport harness with a front member having at least one release latch on one end, a structural side member releasably securable to the release latch and a bracket for receiving the side member and releasably securing the side member, wherein a length of the side member extending through the bracket is adjustable.

This disclosure also includes a wind sport harness having a spreader bar with a front member having at least one release latch on one end, a structural side member releasably securable to the release latch and a bracket for receiving the side member and releasably securing the side member, wherein a length of the side member extending through the bracket is adjustable and wherein the bracket is secured to a back member of the harness.

Still further, the disclosure includes a method for employing a wind sport harness. The method may involve providing the wind sport harness having a spreader bar with a front member having at least one release latch on one end, a structural side member releasably securable to the release latch and a bracket for receiving the side member and releasably securing the side member. A length of the side member extending through the bracket may be adjusted and the bracket and side member may be secured. The at least on release latch may be closed. The at least one release latch may be opened to disengage a user from the harness without altering the side member length adjustment. The harness may have a rigid back plate, with the bracket mechanically connected to the back plate, so that closing the at least one release latch may create a a unitary mechanical connection around a user.

BRIEF DESCRIPTION OF THE DRAWINGS

Further features and advantages will become apparent from the following and more particular description of the preferred embodiments of the disclosure, as illustrated in the accompanying drawings, and in which like referenced characters generally refer to the same parts or elements throughout the views, and in which.

DESCRIPTION OF THE INVENTION

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

Figure 1:
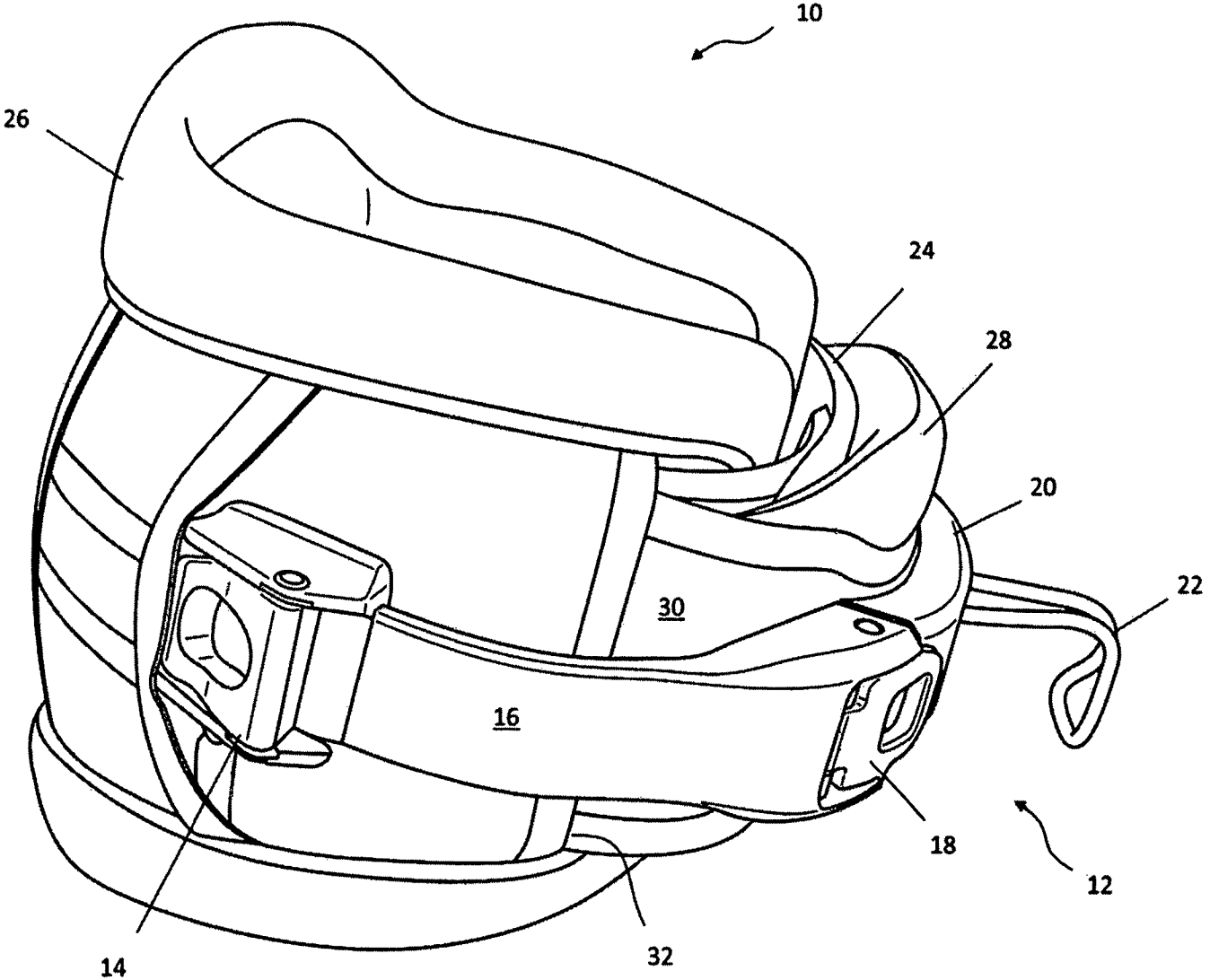
FIG. 1 is a schematic side view of a harness and spreader bar according to an embodiment.
Figure 2:
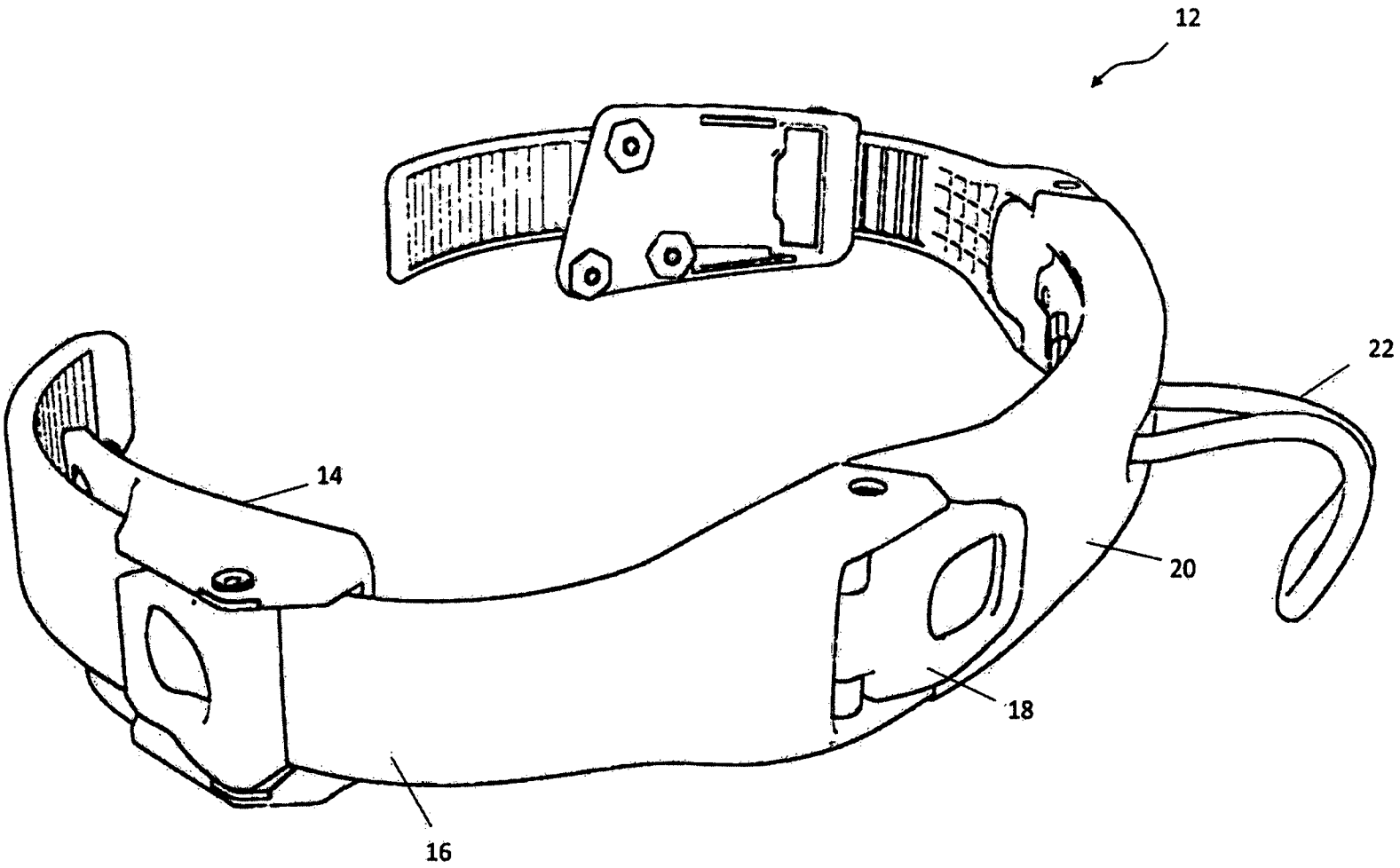
FIG. 2 is a schematic detail view showing structural components of the spreader bar according to an embodiment.

Aspects of this disclosure may be appreciated in the context of the exemplary embodiment depicted in FIG. 1, showing a side view of harness 10 that incorporates spreader bar 12, and FIG. 2, showing a detail view of the main structural components of FIG. 1. Although this embodiment is generally configured to be worn around the waist of the user, the techniques of this disclosure may be applied to other known harness designs, such as chest or seat harnesses with suitable modifications. Equally, a harness embodying these features may be used for kiteboarding, kitesurfing and windsurfing, as well as any other pursuit that involves the attachment of a user to an external propulsive force such as landboarding, snowkiting, wingsurfing, and the like.

Primary connection of spreader bar 12 to harness to is provided by adjustable brackets 14 that receive and releasably secure side members 16. Opposing brackets 14, secured to the body of harness 10 may be employed on both sides of spreader bar 12 to help facilitate centering the spreader bar or to provide more options for size adjustment to accommodate the varying body types of different users, but another connection, including a permanent connection, may be used on one end if desired. In this embodiment, side members 16 have a ribbed surface (see FIG. 2 for example) that engages a complementary feature on bracket so that a mechanical connection is formed when bracket 14 is clamped closed, preventing slippage of side members 16 and loosening of harness 10 during use. Still further, each side member 16 is releasably secured by release latches 18 to front member 20 that carries hook 22, although other components for facilitating attachment to the propulsive force may also be used as known in the art, such as ring, rope slider or others. Use of two release latches 18 on either side of front member 20 creates an ambidextrous interface that allows the user to easily release the harness without altering the size adjustment established by the connection between the side members and the brackets. In other embodiments, one end of front member 20 can be secured to its corresponding side member 16 using any other suitable connection, including a permanent connection. Notably, release latches 18 may employ an over center mechanism that acts to provide a final tightening of the spreader bar 12 when engaged, as well as biasing the latch to a closed position. Among other benefits, this allows the relative length of each side member 16 to be adjusted to a snug fit around the user without requiring more complex mechanisms that can be difficult to engage if under tension or without requiring brackets 14 to feature a tightening function other than by changing the relative amounts of side member 16 that are advanced through bracket 14 before closing. In other embodiments, other tightening mechanisms may be used.

Padding, fabric covers and similar common features may also be employed as known in the art. For example, waist belt 24 may be formed in part from elastic materials and/or may be releasably secured together by buckles, clips, hook and loop fasteners or other suitable mechanisms to provide a relatively snug fit around the user's waist, improving the overall fit between the user and harness 10 while also helping retain the harness in position while side members 16 are adjusted and/or while release latches 18 are engaged. Further, padding 26 may be provided around the edges and the inner surface of the back of harness 10 to cushion the engagement with the user. For example, a fabric covered foam or the equivalent may be used. This padding may also extend to the waistbelt and may be substantially continuous to provide a uniform surface for contact with the user to avoid pressure points. Padding 28 may also provide cushioning between the user's abdomen and the spreader bar. Additionally, front member 20 may include a resilient, but still flexible backing plate 30 that helps spread the forces transmitted through front member 20. Backing plate 30 may extend beyond each end of front member 20 and extend into pockets 32 in harness 10 to help orient front member 20 properly and keep it in position prior to the closing of brackets 14 and/or latches 18. Still further, elastic cover 34 may retain the adjustable ends of side members 16 that extend distally from brackets 14 to create a smooth outer profile and to reduce the chance of catching the free ends on other objects, such as kite lines or safety equipment.

Figure 3:
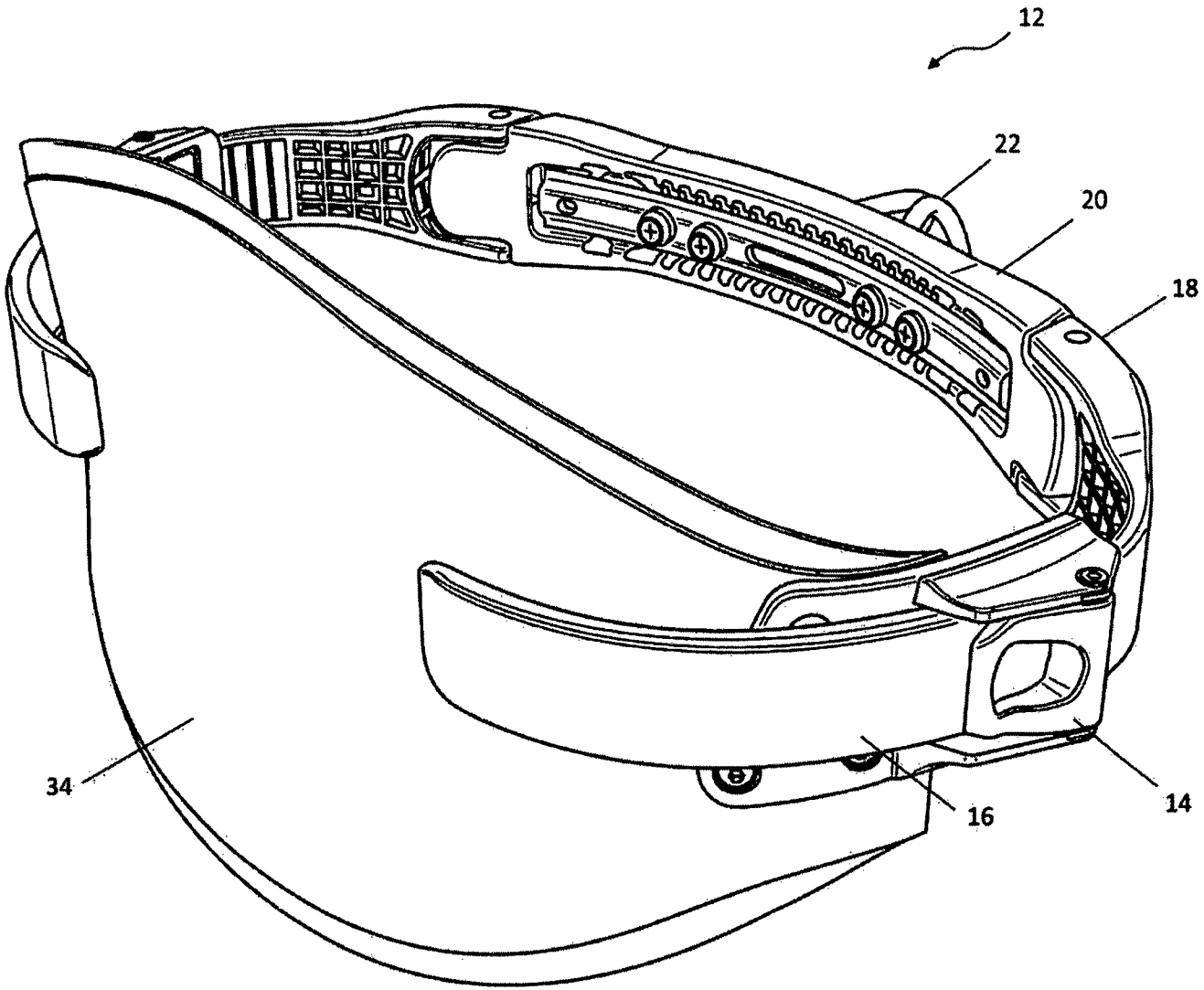
FIG. 3 is a schematic view of the spreader bar secured to a rigid back plate according to an embodiment.

As noted above, brackets 14 are secured to the body of harness 10. In the embodiment of FIG. 3, the back of harness 10 is formed by a rigid external composite plate 34 that tapers from the center of the back to relatively narrower portions to which adjustable brackets 14 are secured. Although the designs of this disclosure benefit from the connection between the relatively rigid spreader bar 12 and rigid back plate 34, a back member can use less rigid materials, such as relatively resilient polymeric materials, while still providing sufficient structural points of attachment and may be more comfortable for some users. Preferably, the back member may be at least as rigid as the side members, but more flexible or soft materials may be used as well.

When employed, back plate 34 is configured to distribute the forces transferred from the harness to the lumbar region of the back and hips of the user in this configuration. Accordingly, plate 34 may be contoured to conform closely to the anatomy of the user. For example, plate 34 may be shaped to a mold representative of a user's body and different molds may be provided to accommodate different anatomies. This results in an effective and even distribution of the transferred forces as well as serving to keep the harness in a specific orientation and position on the user. In one aspect, plate 34 may be formed from a suitable composite material that includes reinforcing members embedded in a binder matrix. For example, the reinforcing members may be formed from fibers, fabrics or the like of any suitable material, including carbon, glass, boron, basalt, Nylon, Kevlar and the like. The binder matrix may be formed from suitable polymeric materials, including polyester and epoxy. The reinforcing members may be "wet out" or saturated with the polymer prior to curing to achieve desired structural characteristics. In some embodiments, the reinforcing member may have a three-dimensional structure such as a honeycomb configuration or the like. By employing such materials, plate 34 may feature superior characteristics for receiving and distributing forces. Back plate 34 may also be formed from other materials, such as plastic, resin, metal or others to create a component having greater rigidity than webbing or fabrics.

As noted above, a feature of this disclosure is that a unitary structural connection is formed around the user's torso during use. This results from the cooperation of the noted components, specifically brackets 14 securing side members 16, front member 20 attached to side members 16 by release latches 18, and in embodiments including it, the connection of brackets 14 to back plate 34. Each of these components is discussed in greater detail below.

Side members 16 are structurally connected to back plate 34 or other back member via brackets 14. During manufacture, the brackets may be permanently affixed to the back plate using screws, rivets or other mechanical connections that are not intended to be released during normal usage of the harness. By employing multiple points of attachment between each bracket 14 and back plate 34, a more rigid connection is formed that avoids the potential of pivoting or flexing around one attachment. The multiple points of attachment also serve to spread the forces across greater areas of brackets 14 and back plate 34. In the depicted embodiment, the multiple points of attachment are shown to be spaced at approximately the width of side member 16. Alternatively, housings of brackets 14 may be formed integrally with back plate 34 as desired. By employing relatively wide material, side members 16 resist deflection out of the plane defined by the encircling of the user's torso. For example, the side members may have a minimum width greater than approximately 2.5 cm. In one embodiment, the side member has a width of 3.5 cm.

Figure 4:
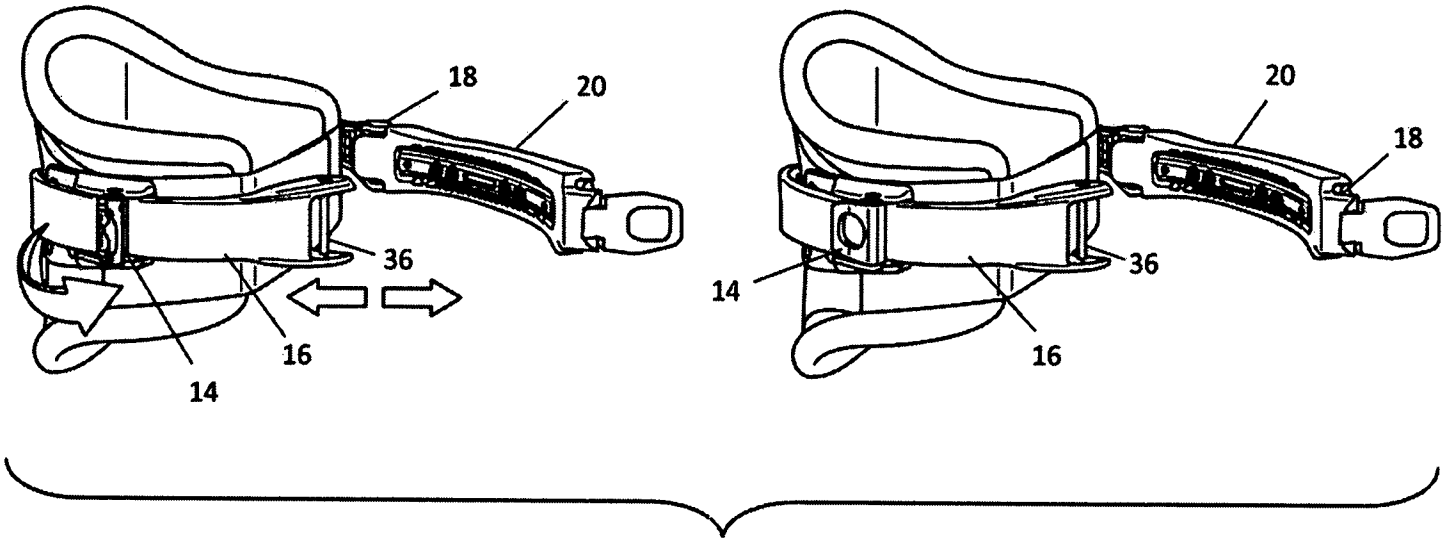
FIG. 4 schematically depicts a sequence showing the adjustment of side member in the spreader bar according to an embodiment.

Moreover, although adjustable, brackets 14 feature a lever or similar structure for clamping the side members to accommodate different sizing requirements. As discussed above, this may include the use of longitudinal ribs formed on a surface of side members 16 that can be engaged by a complimentary feature of brackets 14 when clamped closed. The clamping configuration benefits from the increased width of the side members by forming the connection with the brackets along all or at least a substantial portion of that width, correspondingly contributing to the resistance to deflection discussed above. Still further, brackets 14 may be sized to closely accommodate the width of side members 16 to provide additional resistance to out of plane deflection. Side members 16 may be formed from plastics, resins or composite materials. As an illustration, a glass filled nylon material offers suitable characteristics. In some embodiments, side members 16 may be relatively more flexible than back plate 34 or front member 20 while still offering greater rigidity than other materials used in conventional harness design, such as webbing or the like. For example, when using a glass filled nylon material as noted above, a side member having a width of 3.5 cm and a thickness of 6 mm where engaged by bracket 14 exhibits suitable properties and provides a desired degree of rigidity. More generally, other thicknesses may be used as warranted, particularly in relation to the material used, and may have a thickness of greater than approximately 3 mm for example. The end of side member 16 that is engaged by latch 18 may also have a different configuration to accommodate the attachment. It will be appreciated that the configuration of side members 16 inherently allows some flexibility for deflection within the plane formed when encircling the user's torso and greater resistance to deflection out of the plane. In particular, flexing when conforming to the user's torso represents a deflection of the thickness dimension while any out of plane flexing would represent a deflection of the width dimension. Additionally, side members 16 can be made relatively more rigid by employing a pre-curved configuration as shown to reduce the amount of in plane flexibility needed while still allowing adjustment to fit users of different sizes. Adjustment of side members 16 is schematically shown in FIG. 4. Particularly, in the left view, the bracket lever is opened to allow lateral adjustment of the side member within the bracket housing as indicated. Correspondingly, the right view shows the lever clamped closed so as to retain the side member at the desired adjustment. The same adjustment may be performed on the other side of the harness, which allows the spreader bar to be symmetrically positioned at the center of the user's torso.

Next, the ends of each side member 16 are in turn releasably attached to front member 20 by latches 18 at opposing ends. By employing two latches, the opening and closing of the harness can be accomplished using either hand, providing the user with an ambidextrous interface as noted above. However, in other embodiments one of the latches may be omitted and replaced with a more permanent connection, such as a hinge, to reduce costs or increase simplicity as warranted. Front member 20 may be formed from any material having the necessary structural strength, such a plastics, resins, composite materials, metals or others. Generally, front member 20 may be relatively more rigid than side members 16. In one aspect, release latches 18 engage a longitudinally oriented bar 36 on each side member 16, allowing the formation of a mechanical connection across most of the width of front member 20. As will be appreciated, this connection may allow a degree of freedom so that front member 20 can pivot outwards at the closed latch when the other latch is opened as shown in the right side view of FIG. 4. However, because latch 18 engages along the length (which as noted above, represents most of the width of the spreader bar) of the longitudinal bar when closed, it further resists out of plane deflection. This connection also resists torsional twisting of front member 20 with respect to side members 16 and other harness components.

Figure 5:
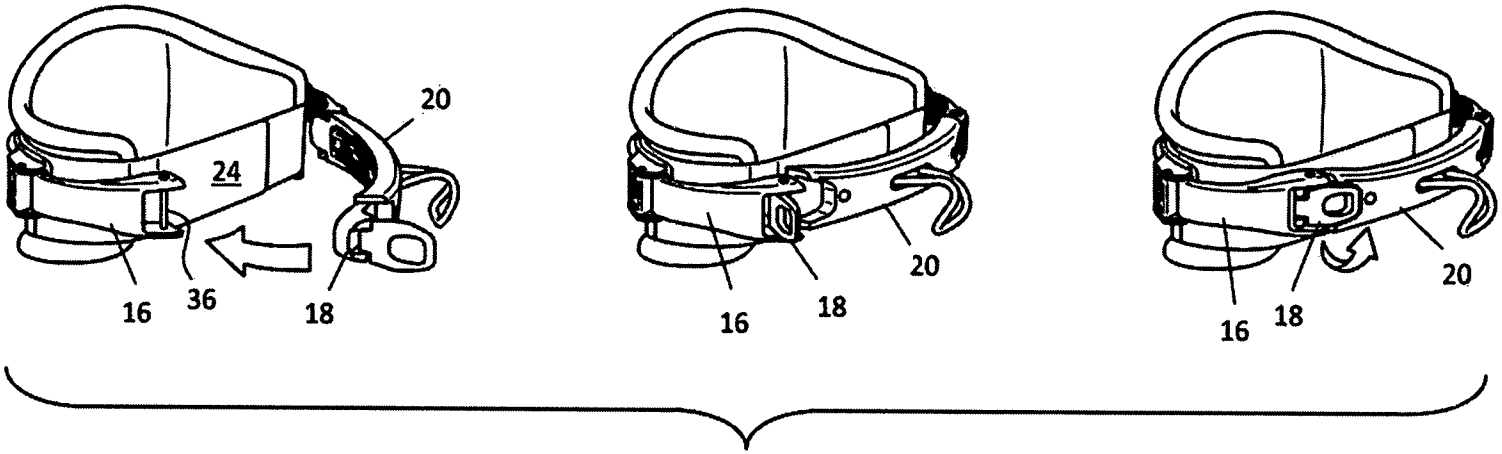
FIG. 5 schematically depicts a sequence showing the latch closure of the spreader bar according to an embodiment.

Next, a schematic representation of the harness closing is shown FIG. 5. In the left view, front member 20 is pivoted towards the already adjusted side member 16. As shown, waistbelt 24 may be used to help hold the harness in position while front member 20 is being closed and is discussed in further detail below. In the center view, latch 18 on front member 20 has been positioned to engage the longitudinal bar of side member 16 so that when closed, as shown in the right view, latch 18 secures front member 20 to side member 16. Since the harness can be opened and closed using either latch 18 rather than by adjusting side member 16 within brackets 14, the size adjustment is not lost until the user positively changes the lateral positions of the side members in the brackets. In the resulting closed configuration, a complete, unitary connection is formed around the user's torso. Notably, the designs of this disclosure can avoid the use of any materials relatively more flexible than the side members when forming this unitary connection. In contrast, conventional harness designs have required the use of more flexible components such as webbing or fabrics to form at least a portion of the connection around the user. Thus, even though such conventional designs might also employ rigid spreader bars, they are nevertheless subject to the flexibility of the other materials used.

Accordingly, it will be appreciated from the above that a harness having the features of this disclosure provides a number of benefits. Once the side members have been adjusted within the brackets for a particular user, no further adjustment is needed when taking off and putting on the harness. Further, slippage often results when using a webbing connection in conventional harness. Typically, a user may have to over tighten a conventional harness initially to achieve the desired fit during use. However, the mechanical engagement between the side members and the brackets eliminates slipping, so such over tightening is not required and helps ensure that the harness remains at the desired fit during use. Additionally, the overall configuration of the harnesses of this disclosure resist deflection out of plane and torsional twisting as discussed above, reducing unwanted changes in spreader bar position during use, such as rising due to the upward pull of a kite for example. Employing latch closures on each side of the front member also provides an ambidextrous user interface, allowing the user to open or close the harness with either hand. Notably, all the mechanical connections and components forming the unitary enclosure of the user's torso may be at least as rigid as established by the width of the side members, which as discussed above, is configured to significantly resist out of plane deflection in this dimension. In comparison, connections employing relatively flexible materials, including webbing laced through buckles, rope/line and/or stitching are not considered mechanical connections within the context of this disclosure. In short, the use of relatively rigid materials that mechanically couple to each other create a solid, continuous, unitary connection of the side members and front member, as well as with the rigid back plate when used, providing better support, fit and performance.

Described herein are certain exemplary embodiments. However, one skilled in the art that pertains to the present embodiments will understand that the principles of this disclosure can be extended easily with appropriate modifications to other applications.

What is claimed is:

1. A spreader bar for a wind sport harness comprising a front member having at least one release latch on one end, a structural side member releasably securable to the release latch and a bracket for receiving the side member and releasably securing the side member, wherein a length of the side member extending through the bracket is adjustable and wherein the release latch transitions between open and closed configurations upon user actuation independent of length adjustment of the side member.

2. The spreader bar of claim 1, further comprising two side members, wherein the front member has release latches on opposing ends and wherein each release latch releasably secures a side member.

3. The spreader bar of claim 2, further comprising two brackets, wherein each bracket is configured to releasably secure one of the side members.

4. The spreader bar of claim 1, wherein the release latch allows opening a harness with the spreader bar without altering the connection between the side member and the bracket.

5. The spreader bar of claim 1, wherein the release latch is configured to tighten upon closure.

6. The spreader bar of claim 5, wherein the release latch employs an over center mechanism.

7. The spreader bar of claim 3, wherein each bracket is secured to opposing ends of a rigid back plate of a harness.

8. The spreader bar of claim 3, wherein each bracket is secured to opposing ends of a back plate that has at least equivalent resiliency as compared to the side member.

9. The spreader bar of claim 1, wherein each of the releasable securing of the side member to the front member and the releasable securing of the side member to the bracket causes greater resistance to out of plane deflection relative to in plane deflection.

10. The spreader bar of claim of claim 1, wherein the release latch engages a longitudinal bar on the side member having a length that is substantially the same as a width of the side member.

11. A wind sport harness comprising a spreader bar with a front member having at least one release latch on one end, a structural side member releasably securable to the release latch and a bracket for receiving the side member and releasably securing the side member, wherein a length of the side member extending through the bracket is adjustable and wherein the bracket is secured to a back member of the harness.

12. The wind sport harness of claim 11, further comprising two side members, wherein the front member has release latches on opposing ends and wherein each release latch releasably secures a side member and further comprising two brackets, wherein each bracket is configured to releasably secure one of the side members and wherein each bracket is secured to opposing ends of the back member.

13. The wind sport harness of claim 11, wherein the release latch allows opening a harness with the wind sport harness without altering the connection between the side member and the bracket.

14. The wind sport harness of claim 13, wherein the release latch is configured to tighten upon closure.

15. The wind sport harness of claim 12, wherein the back member is a rigid back plate.

16. The wind sport harness of claim 15, wherein a unitary structure is formed around a user consisting only of mechanical connections to materials at least as rigid as the side member.

17. A method for wearing a wind sport harness comprising:

providing the wind sport harness having a spreader bar with a front member having at least one release latch on one end, a structural side member releasably securable to the release latch and a bracket for receiving the side member and releasably securing the side member;

adjusting a length of the side member extending through the bracket and securing the bracket and side member; and closing the at least one release latch, wherein the release latch transitions between open and closed configurations upon user actuation independent of length adjustment of the side member.

18. The method of claim 17, further comprising opening the at least one release latch to disengage a user from the harness without altering the side member length adjustment.

19. The method of claim 17, wherein the harness comprises a rigid back plate, wherein the bracket is mechanically connected to the back plate and wherein closing the at least one release latch creates a unitary mechanical connection around a user.

* * * * *